US008965228B2

(12) United States Patent
Amaike et al.

(10) Patent No.: US 8,965,228 B2
(45) Date of Patent: Feb. 24, 2015

(54) IMAGE FORMING APPARATUS

(75) Inventors: Takuya Amaike, Nagoya (JP); Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 446 days.

(21) Appl. No.: 13/244,116

(22) Filed: Sep. 23, 2011

(65) Prior Publication Data

US 2012/0076522 A1 Mar. 29, 2012

(30) Foreign Application Priority Data

Sep. 28, 2010 (JP) ..... 2010-216616

(51) Int. Cl.
*G03G 15/16* (2006.01)
*G03G 21/00* (2006.01)

(52) U.S. Cl.
CPC ..... *G03G 21/00* (2013.01); *G03G 15/168* (2013.01); *G03G 2215/1661* (2013.01)
USPC ..... 399/66

(58) Field of Classification Search
CPC ..... G03G 15/168; G03G 2215/1661; G03G 2215/1647
USPC ..... 399/360, 66, 123
See application file for complete search history.

(56) References Cited

U.S. PATENT DOCUMENTS

| | | | | |
|---|---|---|---|---|
| 6,035,154 | A | 3/2000 | Takahata et al. | |
| 2006/0056857 | A1* | 3/2006 | Watanabe et al. | 399/12 |
| 2008/0317506 | A1 | 12/2008 | Furukawa | |
| 2009/0142116 | A1* | 6/2009 | Sato et al. | 399/360 |

FOREIGN PATENT DOCUMENTS

| | | | | |
|---|---|---|---|---|
| JP | H09-080907 | A | 3/1997 | |
| JP | H11-161052 | A | 6/1999 | |
| JP | 2000-029365 | A | 1/2000 | |
| JP | 2000250336 | A * | 9/2000 | G03G 15/16 |
| JP | 2000-330400 | A | 11/2000 | |
| JP | 2006-343360 | A | 12/2006 | |
| JP | 2009-003377 | A | 1/2009 | |
| JP | 2009134198 | A * | 6/2009 | |
| JP | 2010-197523 | A | 9/2010 | |

OTHER PUBLICATIONS

Machine translation of Watanabe et al., JP 2000-250336.*
Machine translation of Tsukada, JP 2009-134198.*
Decision of Patent Grant, JPO, Application 2010-216616, corresponding to U.S. Appl. No. 13/244,116 (2012).*

* cited by examiner

*Primary Examiner* — David Gray
*Assistant Examiner* — Sevan A Aydin
(74) *Attorney, Agent, or Firm* — Baker Botts L.L.P.

(57) ABSTRACT

An image forming apparatus includes a controller capable of performing a printing control and a cleaning control. In the printing control, developer images carried on the image carriers are transferred toward the opposing surface or a recording sheet by applying a transfer current between each of the image carriers and the transfer device. In the cleaning control, developer collected by the cleaning rollers is transferred toward the image carriers and the transfer device and collected by the cleaning device by applying a transfer current between each of the image carriers and the transfer device and switching an electric field established between the image carrier and the corresponding cleaning roller. The controller is configured to control the transfer current such that an average absolute value of the transfer current in the cleaning control is smaller than that in the printing control.

4 Claims, 5 Drawing Sheets

CONTROLLER
100
UP
DOWN
FRONT
REAR
1
2
2A
3
4
5
10
11
12
13
14
15
20
21
22
23
24
25
26
27
28
30
40
50C(50)
50M(50)
50Y(50)
50K(50)
51
52
53
54
55
70
71
72
73
73A
74
80
81
82
90
91
92
510
530
P

IMAGE FORMING APPARATUS

BACKGROUND OF THE INVENTION

1. Field of the Invention

The present invention relates to an image forming apparatus capable of performing a cleaning control in which toner (developer) collected by cleaning rollers is transferred to a belt (transfer device) through photoconductor drums (image carriers) and collected by a cleaning device.

2. Description of Related Art

Conventionally, there is known an image forming apparatus comprising a plurality of photoconductor drums, a plurality of cleaning rollers each of which is adjacent to a corresponding photoconductor drum and configured to collect toner adhering to the surface of the corresponding photoconductor drum, a rotatable endless belt arranged opposite the photoconductor drums, a plurality of transfer rollers each of which is arranged opposite the corresponding photoconductor drum with the belt interposed therebetween, and a cleaning device for collecting toner adhering to the belt. In this image forming apparatus, a printing control and a cleaning control can be performed.

More specifically, in the printing control, a transfer current is applied between each of the photoconductor drums and the belt (the corresponding transfer roller) so that toner images carried on the photoconductor drums are transferred onto a recording sheet conveyed on the belt. In the cleaning control, a transfer current which has substantially the same magnitude as that in the printing control is applied between each of the photoconductor drums and the belt, and further an electric current is applied between each of the photoconductor drums and the corresponding cleaning roller so that toner collected by the cleaning rollers is transferred to the belt through the photoconductor drums and collected by the cleaning device.

SUMMARY OF THE INVENTION

According to the conventional image forming apparatus, since the transfer current which has substantially the same magnitude as that in the printing control is applied during the cleaning control between the photoconductor drum and the transfer roller, the total amount of transfer current flowing to the transfer roller becomes too large and the resistance value of the transfer roller varies to a larger value or a smaller value; this is so-called energization deterioration (energization increase or energization drop). Energization deterioration may degrade the image quality of the image forming apparatus.

In view of the above, it is desirable to improve the image quality of the image forming apparatus by suppressing a generation of energization deterioration.

According to the present invention, there is provided an image forming apparatus comprising: a plurality of image carriers each configured to carry a developer image; a transfer device having an opposing surface opposite the plurality of image carriers, and configured to rotate to move the opposing surface along a direction of arrangement of the plurality of image carriers, whereby developer is transferred from the image carriers to the opposing surface; a plurality of cleaning rollers each provided adjacent to a corresponding image carrier and configured to temporarily collect at least part of developer adhering to the image carrier; a cleaning device configured to collect developer adhering to the opposing surface of the transfer device; and a controller capable of performing a printing control and a cleaning control. In the printing control, developer images carried on the image carriers are transferred toward the opposing surface or a recording sheet by applying a transfer current between each of the image carriers and the transfer device; and in the cleaning control, developer collected by the cleaning rollers is transferred toward the image carriers and the transfer device and collected by the cleaning device by applying a transfer current between each of the image carriers and the transfer device and switching an electric field established between the image carrier and the corresponding cleaning roller. The controller is configured to control the transfer current such that an average absolute value of the transfer current in the cleaning control is smaller than that in the printing control.

It is to be noted that "switching an electric field established between the image carrier and the corresponding cleaning roller" means controlling electric voltage or electric current such that the direction of electric field is reversed or the electric field intensity is changed. More specifically, the electric voltage or the electric current is controlled to switch between an electric field in which developer travels from the cleaning roller to the image carrier and an electric field in which developer travels from the image carrier to the cleaning roller.

BRIEF DESCRIPTION OF THE DRAWINGS

To better understand the claimed invention, and to show how the same may be carried into effect, reference will now be made, by way of example only, to the accompanying drawings, in which:

DETAILED DESCRIPTION OF EXEMPLARY EMBODIMENTS

Figure 1:
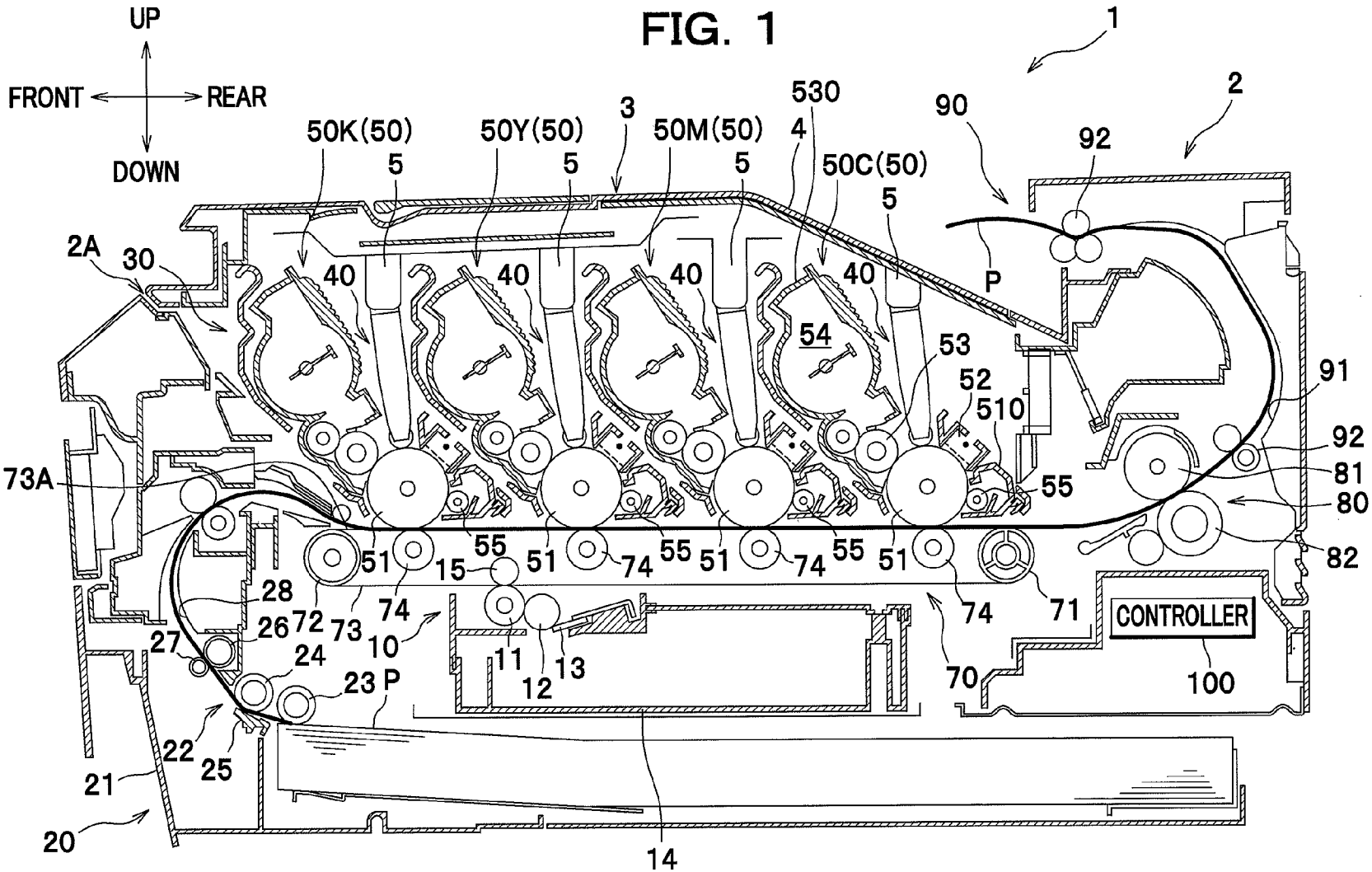
FIG. 1 is a side sectional view of a color printer as one exemplary embodiment of an image forming apparatus according to the present invention.

Detailed description will be given of illustrative embodiments of the present invention with reference to the drawings. In the following description, unless otherwise stated, directions of a color laser printer refer to the directions as seen from a user facing to the printer during its use. To be more specific, with reference to FIG. 1, the left-hand side of the drawing sheet corresponds to the "front" side of the printer, the right-hand side of the drawing sheet corresponds to the "rear" side of the printer, the front side of the drawing sheet corresponds to the "right" side of the printer, and the back side of the drawing sheet corresponds to the "left" side of the printer. Similarly, the direction extending from top to bottom of the drawing sheet corresponds to the "vertical" or "up/down (upper/lower or top/bottom)" direction of the printer.

<General Arrangement of Color Laser Printer>

As seen in FIG. 1, a color printer 1 comprises a main body casing 2, and several components housed within the main body casing 2 which principally includes a sheet feeding unit 20 configured to feed a sheet of paper P (hereinafter simply referred to as a "sheet" P) as an example of a recording sheet, an image forming unit 30 configured to form an image on the sheet P supplied from the sheet feeding unit 20, a sheet output unit 90 configured to discharge the sheet P having the image thereon from the main body casing 2, and a controller 100.

An opening 2A is formed at an upper part of the main body casing 2, and an upper cover 3 is pivotally supported on the main body casing 2 so as to swingably open or close the opening 2A. The upper surface of the upper cover 3 provides a sheet output tray 4 for receiving and stacking sheets P discharged from the main body casing 2. A plurality of LED attachment portions 5 for retaining LED units 40 are provided at the lower surface of the upper cover 3.

The sheet feeding unit 20 is arranged at a lower part of the main body casing 2, and mainly includes a sheet feed tray 21 detachably attached to the main body 10, and a sheet feed mechanism 22 configured to convey a sheet P from the sheet feed tray 21 to the image forming unit 30. The sheet feed mechanism 22 is positioned in front of the sheet feed tray 21, and mainly includes a feed roller 23, a separation roller 24, and a separation pad 25.

The sheet feeding unit 20 separates a stack of sheets P stored in the sheet feed tray 21 and conveys a sheet P on one-by-one basis upwardly toward the image forming unit 30, during which the sheet P passes between a paper dust removing roller 26 and a pinch roller 27 to remove paper dust from the sheet P and thereafter the sheet conveyance direction of the sheet P is reversed in the rearward direction along a sheet conveyance passage 28.

The image forming unit 30 mainly includes four LED units 40, four process cartridges 50, a transfer unit 70, a cleaning device 10, and a fixing unit 80.

Each LED unit 40 is swingably connected to the corresponding LED mounting portion 5, and supported in a predetermined position by a positioning member provided in the main body casing 2.

The four process cartridges 50 are disposed between the upper cover 3 and the sheet feeding unit 20, and arranged tandem in the front-and-rear direction of the color printer 1. Each process cartridge 50 includes a photoconductor drum 51 as an example of an image carrier, a charger 52, a development roller 53, a toner storage chamber 54 for storing toner as an example of developer, and a cleaning roller 55.

The four process cartridges 50 include a black process cartridge 50K for black color printing in which black toner is stored, a yellow process cartridge 50Y for yellow color printing in which yellow toner is stored, a magenta process cartridge 50M for magenta color printing in which magenta toner is stored, and a cyan process cartridge 50C for cyan color printing in which cyan toner is stored, and these process cartridges are arranged in this order along the sheet conveyance direction (i.e., moving direction of the belt surface) from the upstream side to the downstream side thereof. In the specification and the drawings, in the case where the photoconductor drum 51, the development roller 53, the cleaning roller 55, etc. will be specified by the color of each toner, a suffix such as K for black, Y for yellow, M for magenta, or C for cyan can be added.

The photoconductor drums 51 are provided corresponding to the plurality of process cartridges 50, so that they are arranged in line in the front-and-rear direction of the color printer 1.

The development rollers 53 contact the photoconductor drums 51 to supply toner onto latent images formed on the photoconductor drums 51. According to this embodiment, when toner is supplied from the development roller 53 to the photoconductor drum 51, the toner is subject to frictional contact between the development roller 53 and the supply roller (reference numeral omitted) and charged to a positive polarity.

Figure 2:
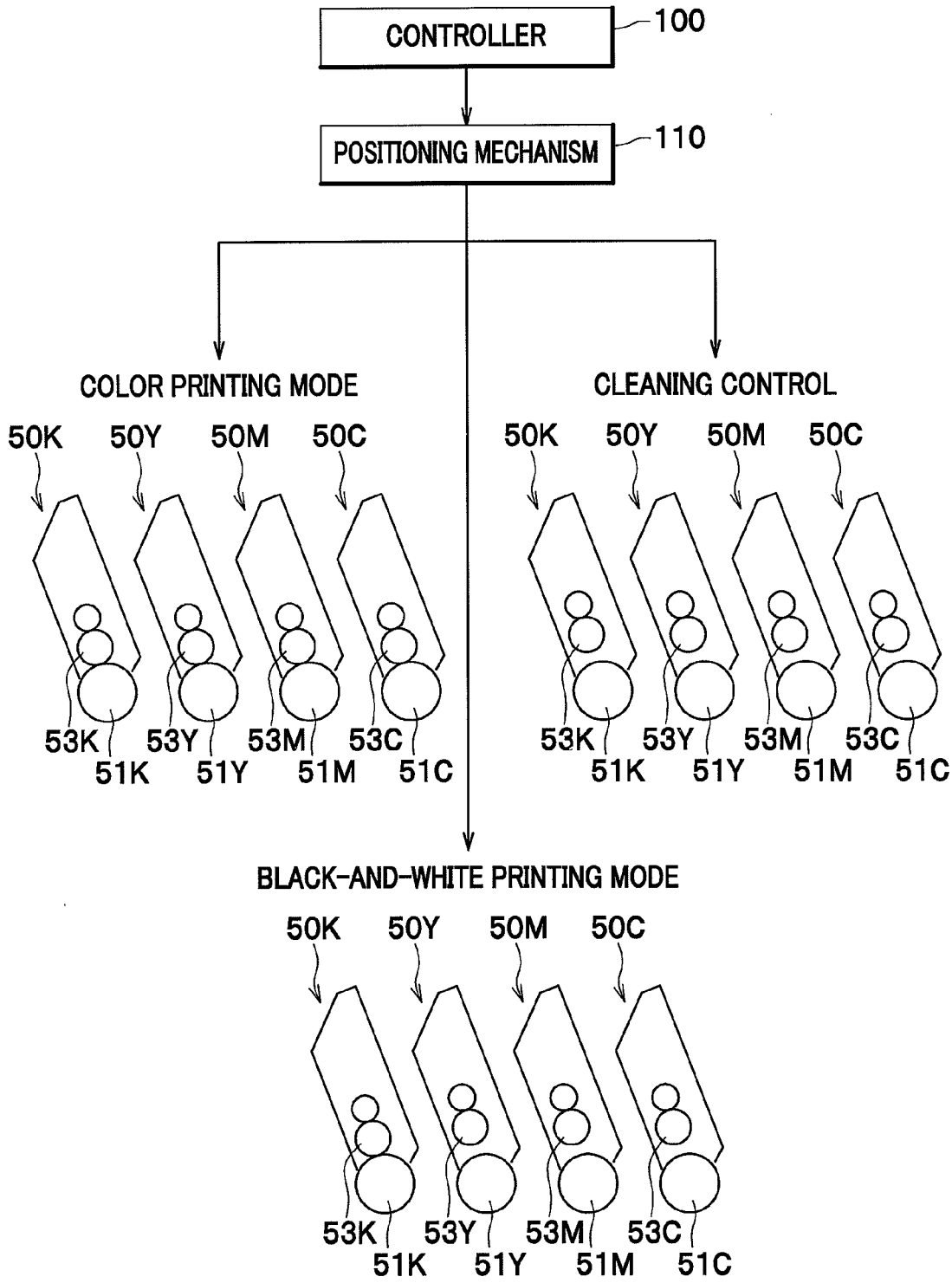
FIG. 2 is a view explaining engagement and disengagement of photoconductor drums and development rollers.

As seen in FIG. 2, the development rollers 53 are brought into contact with or kept away from the photoconductor drums 51 through a known positioning mechanism 110 (e.g., similar to a switching mechanism disclosed in U.S. Pat. No. 7,693,460 B2) which is controlled by the controller 100. To be more specific, all the development rollers 53K, 53Y, 53M, 53C are in contact with the corresponding photoconductor drums 51K, 51Y, 51M, 51C during the color printing mode, so that toner is supplied to the photoconductor drums 51K, 51Y, 51M, 51C. On the contrary, during the black-and-white printing mode, only the development roller 53K for black toner (i.e., for black-and-white printing) is in contact with the photoconductor drum 51K and the other three development rollers 53Y, 53M, 53C for other colors are kept away from the corresponding photoconductor drums 51Y, 51M, 51C. Further, during the cleaning control, all the development rollers 53K, 53Y, 53M, 53C are kept away from the corresponding photoconductor drums 51K, 51Y, 51M, 51C.

As best seen in FIG. 1, a plurality of cleaning rollers 55 are provided adjacent to the corresponding photoconductor drums 51. A cleaning bias is applied to each cleaning roller 55, so that at least part of the toner adhering to the surface of the photoconductor drum 51 can be transferred from the photoconductor drum 51 to the cleaning roller 55 and temporarily retained (collected) by the cleaning roller 55.

The transfer unit 70 is disposed between the sheet feeding unit 20 and the process cartridges 50. The transfer unit 70 mainly includes a drive roller 71, a driven roller 72, a conveyor belt 73 as an example of a transfer device, and a transfer roller 74.

The drive roller 71 and the driven roller 72 are spaced apart and disposed parallel to each other in the front-and-rear direction. The conveyor belt 73 in the form of an endless belt is looped around the drive roller 71 and the driven roller 72. The conveyor belt 73 has a belt surface 73A (opposing surface) opposite to and in contact with the photoconductor drums 51 as an outer surface of the conveyor belt 73. The conveyor belt 73 rotates by the rotation of the drive roller 71 such that the belt surface 73A moves along a direction of arrangement of the plurality of photoconductor drums 51. Four transfer rollers 74 are disposed inside the looped conveyor belt 73 opposite the corresponding photoconductor drums 51 with the conveyor belt 73 being interposed therebetween. A transfer bias is applied to each transfer roller 74 by a constant-current control during the transfer of toner.

The cleaning device 10 contacts with the conveyor belt 73 and is configured to collect toner and the like adhering to the surface of the conveyor belt 73. The cleaning device 10 is disposed below the conveyor belt 73. To be more specific, the cleaning device 10 includes a contacting roller 11, a collecting roller 12, a blade 13, and a waste toner reservoir 14.

The contacting roller 11 is arranged in contact with the outer surface of the conveyor belt 73 and configured to collect substance adhering to the conveyor belt 73. When a toner collecting bias is applied between the contacting roller 11 and a back-up roller 15 arranged inside the looped conveyor belt 73, the substance is collected by the contacting roller 11.

The collecting roller 12 is a roller in contact with the contacting roller 11 and configured to collect the substance adhering to the contacting roller 11. The substance adhering to the surface of the collecting roller 12 is scraped off by a blade 13 positioned in sliding contact with the collecting roller 12, and then moves into the waste toner reservoir 14.

The fixing unit 80 is arranged at the rear of the process cartridges 50 and the transfer unit 70. The fixing unit 80 includes a heating roller 81, and a pressure roller 82 positioned opposite the heating roller 81 and pressed against the heating roller 81.

According to the image forming unit 30 as constructed above, in the color printing mode, the surface of each photoconductor drum 51 is positively and uniformly charged by the corresponding charger 52, and exposure to a laser beam emitted from the corresponding LED unit 40. As a result, the electric potential of the exposed area lowers so that an electrostatic latent image associated with image data is formed on the surface of the photoconductor drum 51. Thereafter, the positively charged toner on the development roller 53 is supplied onto the electrostatic latent image, so that a toner image is carried on the photoconductor drum 51.

Toner images formed on the plurality of photoconductor drums 51 are transferred onto a sheet P while the sheet P is conveyed on the conveyor belt 73 and passes between the photoconductor drums 51 and the transfer rollers 74 arranged on the inner side of the conveyor belt 73. When the sheet P passes between the heating roller 81 and the pressure roller 82, the toner images transferred on the sheet P are thermally fixed.

The sheet output unit 90 includes an output-side sheet conveyance passage 91, and plural pairs of conveyor rollers 92 for conveying the sheet P along the output-side sheet conveyance passage 91. The output-side sheet conveyance passage 91 extends upwardly from an outlet of the fixing unit 80 and is then inversely directed to extend in the forward direction. The sheet P on which the toner images are transferred and thermally fixed is conveyed along the output-side sheet conveyance passage 91 by the conveyor rollers 92, and ejected from the main body casing 2 and accumulated on the sheet output tray 4.

<Controller>

Detailed description will be given of the controller 100.

The controller includes a CPU, a ROM, a RAM, etc. The controller 100 is configured to receive a printing command (print data) and control the sheet feeding unit 20, the image forming unit 30, the sheet output unit 90, and the positioning mechanism 110 according to a program prepared in advance.

More specifically, the controller 100 is capable of performing a printing control in which a transfer current is applied between each photoconductor drum 51 and the corresponding transfer roller 74, so that the toner image carried on the photoconductor drum 51 is transferred onto the sheet P. The controller 100 is also capable of performing a cleaning control in which a transfer current is applied between each photoconductor drum 51 and the corresponding transfer roller 74 and an electric field established between the cleaning roller 55 and the photoconductor drum 51 is switched, so that toner temporarily collected by the cleaning roller 55 is transferred toward the cleaning device 10 through the photoconductor drum 51 and the conveyor belt 73.

Figure 3:
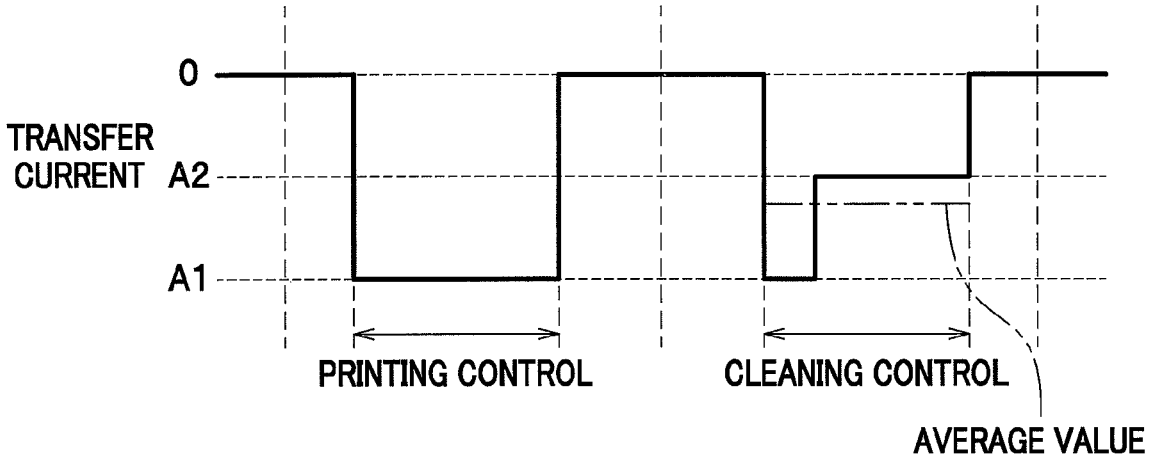
FIG. 3 is a diagram showing transfer current during printing control and cleaning control.

As best seen in FIG. 3, the controller 100 controls the transfer bias (i.e., electric voltage or electric current) applied to each transfer roller 74 such that an average absolute value of the transfer current is smaller in the cleaning control than in the printing control. It is to be noted that "an average absolute value of the transfer current" indicates an electric current value per unit time obtained by dividing the total amount of transfer current for each control by a period time required for each control.

Since the average absolute value of the transfer current is made smaller in the cleaning control than in the printing control, the total amount of transfer current can be decreased and a change in the resistance value of each transfer roller 74 due to an excessive total amount of transfer current can be suppressed.

According to this embodiment, the controller 100 is configured to control the transfer current in the cleaning control such that the transfer current is set at a first current value A1 at the start of the cleaning control and then changed to a second current value A2 having the same polarity as, but smaller in absolute value than the first current value A1. In the cleaning control, the amount of toner transferred from the cleaning roller 55 to the photoconductor drum 51 gradually decreases as the cleaning roller 55 makes one complete rotation. Therefore, at the start of the cleaning control, the transfer current is set at the electric current value A1, which is a higher transfer current, so that a large amount of toner can be transferred efficiently to the conveyor belt 73. Thereafter, the transfer current is set at the electric current value A2, which is a lower transfer current, so that gradually decreasing toner can be transferred to the conveyor belt 73.

Figure 4A:
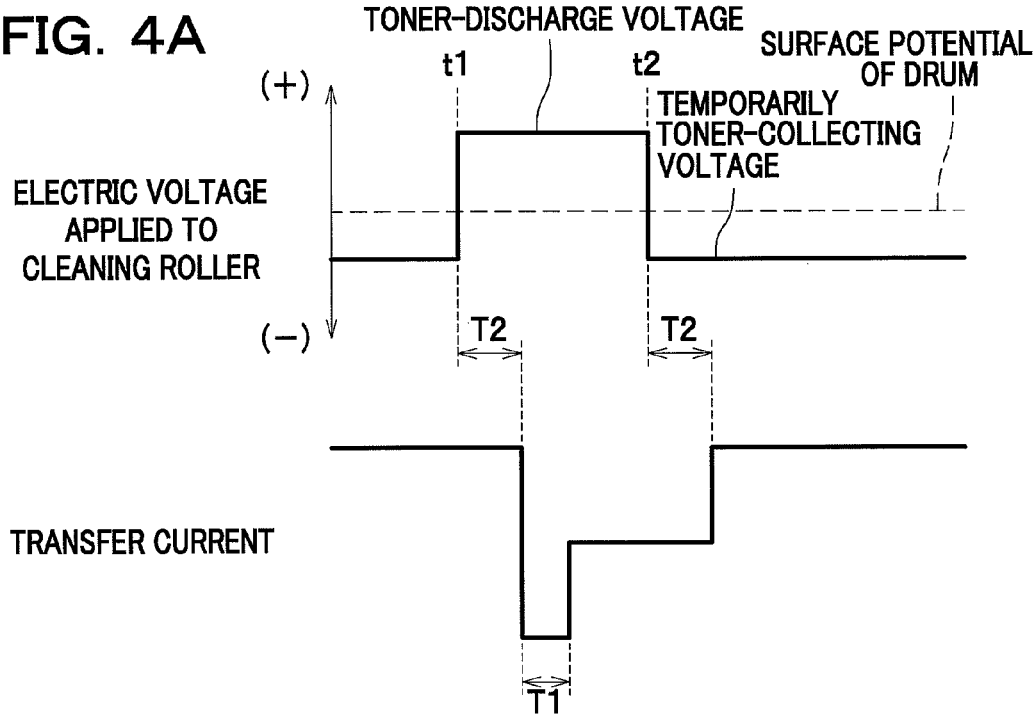
FIG. 4A is a diagram showing relationship between electric voltage applied to a cleaning roller and transfer current.
Figure 4B:
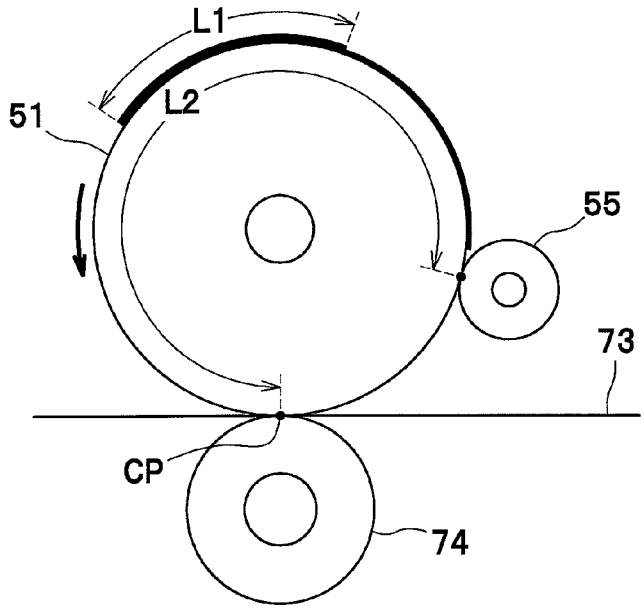
FIG. 4B is a view explaining movement of toner discharged from the cleaning roller to the photoconductor drum.

Further, as best seen in FIGS. 4A and 4B, the controller 100 is configured to change the transfer current in the cleaning control to the first current value A1 for a period of time T1 corresponding to one complete rotation of the cleaning roller 55 (i.e., time required for one complete rotation of the cleaning roller 55). According to this control, as for a large amount of toner adhering to the whole surface of the cleaning roller 55 at the start of the cleaning control, a large amount of toner transferred to the photoconductor drum 51 by the first complete rotation of the cleaning roller 55 (i.e., toner indicated by the range of the length L1) can be reliably transferred onto the conveyor belt 73 using the higher electric voltage A1.

The relationship between transfer current and toner-discharge voltage (electric voltage for toner discharge) applied for transferring toner from the cleaning roller 55 to the photoconductor drum 51 is shown in FIG. 4A. In other words, the controller properly controls a bias applied to the cleaning roller 55 and a bias applied to the transfer roller 74 such that the electric voltage applied to the cleaning roller 55 is switched from a temporarily toner-collecting voltage (electric voltage for temporarily collecting toner), which is lower than the surface potential of the photoconductor drum 51, to the toner-discharge voltage, which is higher than the surface potential of the photoconductor drum 51 (see at time t1) and after the lapse of a predetermined period of time T2, the transfer current is applied between the photoconductor drum 51 and the transfer roller 74.

Herein, the predetermined period of time T2 corresponds to the length of time until the toner discharged from the cleaning roller 55 to the photoconductor drum 51 reaches a transfer position CP; the predetermined period of time T2 is calculated based on the distance L2 and the rotation speed of the photoconductor drum 51. Accordingly, in the cleaning control, the transfer current is not flowed until the toner discharged from the cleaning roller 55 reaches the transfer position CP. This can prevent the transfer current from being applied earlier than necessary, and a change in resistance value of the transfer roller 74 can be further restricted.

Further, the controller 100 causes the supply of the transfer current to be stopped at the timing when the toner-discharge voltage is switched to the temporally toner-collecting voltage (time t2) and a predetermined period of time T2 elapses. Accordingly, in the cleaning control, the transfer current is stopped just after the toner last discharged from the cleaning roller 55 reaches the transfer position CP and is transferred onto the conveyor belt 73. This can prevent the transfer current from being applied more than required, and a change in resistance value of the transfer roller 74 can be further restricted.

Except for the control of the transfer current and the toner-discharge voltage as described above, a conventionally known cleaning control is performed. Namely, the controller 100 causes all the development rollers 53 to be kept away from the corresponding photoconductor drums 51 during the cleaning control. Therefore, toner on all the cleaning rollers 55 is collected by the cleaning device 10.

According to the above exemplary embodiment, all the development rollers 53 are kept away from the corresponding photoconductor drums 51 during the cleaning control. However, the present invention is not limited to this specific configuration. For example, in the cleaning control, the development roller for black toner may be in contact with the corresponding photoconductor drum, while the other development rollers for other colors are kept away from the corresponding photoconductor drums. In this embodiment, since other color toners are not mixed with the black toner on the cleaning roller for black toner, the black toner can be collected through the photoconductor drum onto the development roller (into the development device).

According to the embodiment as described above, the following advantageous effects can be achieved.

Since the controller 100 controls the transfer current such that the average absolute value of the transfer current in the cleaning control is smaller than that in the printing control, a change in the resistance value of the transfer roller 74 can be restricted. Therefore, the image quality of the color printer 1 can be improved by suppressing energization deterioration.

Since the controller 100 controls the transfer current in the cleaning control such that the transfer current is set at the first current value A1 at the start of the cleaning control and then changed to the second current value A2 having the same polarity as, but smaller in absolute value than the first current value, toner can be efficiently transferred onto the conveyor belt 73.

Since the transfer current is set at the first current value A1 for the period of time corresponding to one complete rotation of the cleaning roller 55, toner can be more efficiently transferred onto the conveyor belt 73.

Although the present invention has been described in detail with reference to the above embodiment, the present invention is not limited to this specific embodiment and various changes and modifications as described below may be made without departing from the scope of the appended claims.

In the above embodiment, the transfer current in the cleaning control is changed abruptly from the first current value A1 to the second current value A2. However, the present invention is not limited to this specific control, and the transfer current in the cleaning control may be gradually changed from the first current value to a second to the second current value having the same polarity as, but smaller in absolute value than the first current value.

Herein, the term "value having the same polarity as, but smaller in absolute value" includes zero. Namely, if the first current value is a positive value, the second current value may be a positive value and smaller in absolute value than the first value. The second current value may alternatively be zero. On the contrary, if the first current value is a negative value, the second current value may be a negative value and smaller in absolute value than the first value. The second current value may alternatively be zero.

Figure 5:
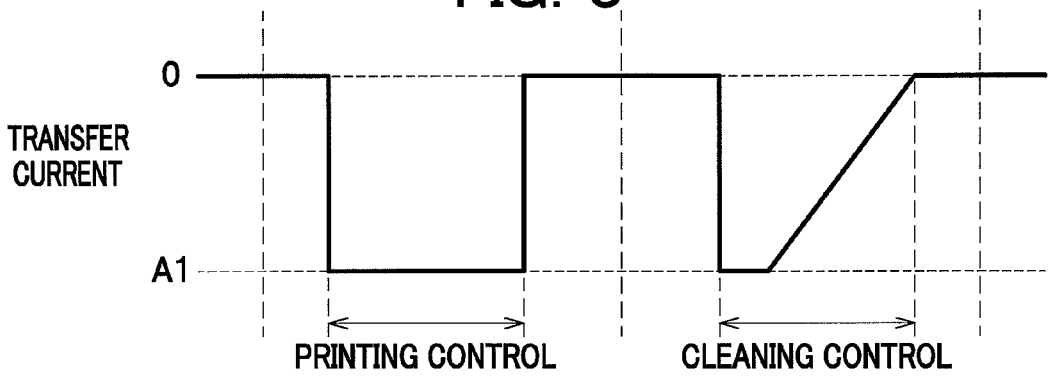
FIG. 5 is a diagram showing an embodiment in which transfer current in the cleaning control is gradually changed from a first current value to a second current value.

As an example where the transfer current in the cleaning control is changed gradually from the first current value to the second current value, as shown in FIG. 5, the transfer current is gradually changed from the first current value A1 toward zero (i.e., second current value) by a predetermined slope. Even in this example, toner can be efficiently transferred onto the conveyor belt.

Figure 6:
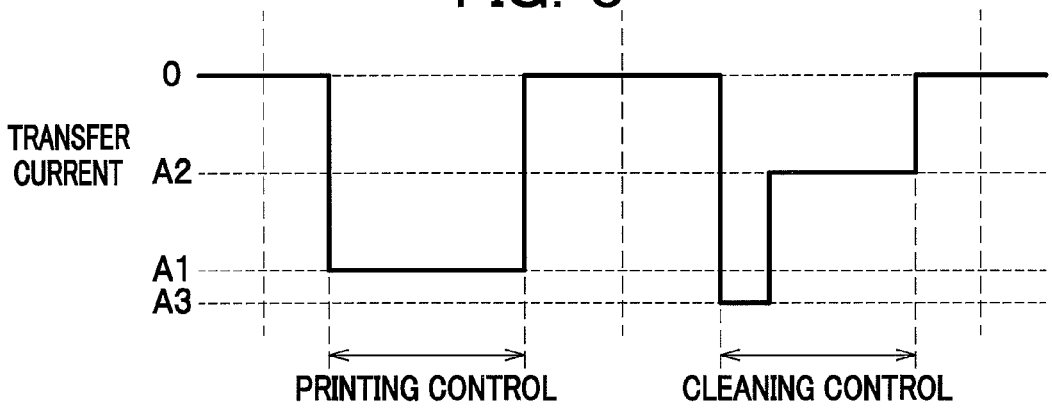
FIG. 6 is a diagram showing another embodiment in which the absolute value of the first current value in the cleaning control is temporarily larger than the average value of the transfer current in the printing control.

In the above embodiment, the transfer current in the cleaning control is controlled such that the first current value A1 has the same value as the average value of the transfer current in the printing control. However, the present invention is not limited to this specific control, and as shown in FIG. 6, the absolute value of the first current value A3 may be greater than the average value (A1) of the transfer current in the printing control.

Figure 7:
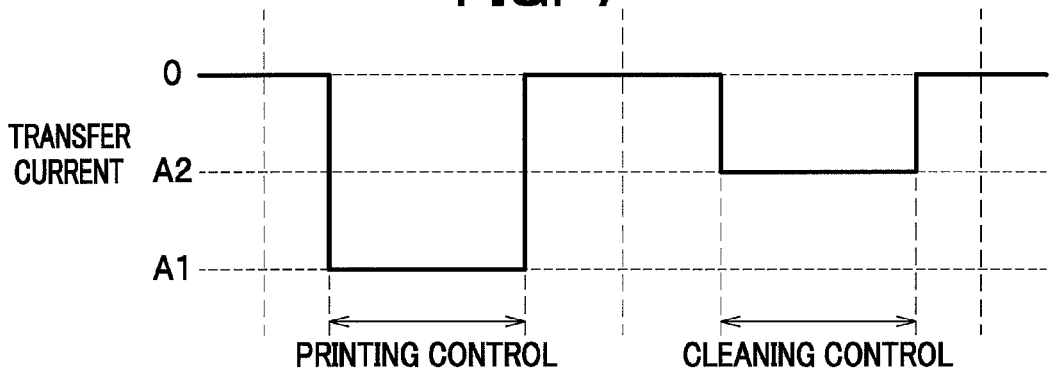
FIG. 7 is a diagram showing still another embodiment in which transfer current is kept constant during the cleaning control.

In the above embodiment, the transfer current in the cleaning control is changed from the first current value A1 to the second current value A2. However, the present invention is not limited to this specific control, and as shown in FIG. 7, the transfer current in the cleaning control may be kept at a constant value (A2). Namely, the transfer current is set, at a first constant current value during the cleaning control, whereas the transfer current is set at a third constant current value during the printing control, and the absolute value of the first constant current value is smaller than that of the third constant current value In the above embodiment, the transfer current is controlled by a constant-current control. However, the present invention is not limited to this specific control. As long as the transfer current changes as in the cases of the above embodiments shown in FIGS. 3, and 5-7, the transfer current may be controlled by a constant-voltage control.

In the above embodiment, the photoconductor drums 51 are employed as a plurality of image carriers. However, the present invention is not limited to this specific configuration. For example, belt-type photoconductors may be employed.

In the above embodiment, the transfer device includes the conveyor belt 73 and a plurality of transfer rollers 74. However, the present invention is not limited to this specific configuration. For example, the transfer device may include an intermediate transfer belt, in which toner on the photoconductor drums is directly transferred onto the belt during the printing control, and a plurality of transfer rollers. Alternatively, the transfer device may include a plurality of photoconductor drums and a large-sized transfer roller in contact with these photoconductor drums.

In the above embodiment, as an example of a cleaning device, the cleaning device 10 includes the contacting roller 11, the collecting roller 12, the blade 13, and the waste toner reservoir 14. However, the present invention is not limited to this specific configuration. For example, the collecting roller 12 may be omitted from the cleaning device 10, and the blade 13 may be positioned in contact with the contacting roller 11.

In the above embodiment, the present invention is applied to the color printer 1. However, the present invention may be applicable to other image forming apparatuses such as a copying machine and a complex machine.

Further, in the above-described embodiment, a sheet P such as a cardboard, a postcard, and a thin paper is used as an example of a recording sheet. However, the present invention is not limited thereto, and an OHP sheet or the like may be used as the recording sheet.

What is claimed is:

1. An image forming apparatus comprising:

a plurality of image carriers each configured to carry a developer image;

a transfer device having an opposing surface opposite the plurality of image carriers, and configured to rotate to move the opposing surface along a direction of arrangement of the plurality of image carriers, whereby developer is transferred from the image carriers to the opposing surface;

a plurality of cleaning rollers each provided adjacent to a corresponding image carrier and configured to temporarily collect at least part of developer adhering to the image carrier;

a cleaning device configured to collect developer adhering to the opposing surface of the transfer device; and a controller capable of performing a printing control and a cleaning control, wherein in the printing control, developer images carried on the image carriers are transferred toward the opposing surface or a recording sheet by applying a transfer current between each of the image carriers and the transfer device, and wherein in the cleaning control, developer collected by the cleaning rollers is transferred toward the image carriers and the transfer device and collected by the cleaning device by applying a transfer current between each of the image carriers and the transfer device and switching an electric field established between the image carrier and the corresponding cleaning roller, wherein the controller is configured to control the transfer current such that the transfer current has the same polarity in the cleaning control and in the printing control and an average absolute value of the transfer current in the cleaning control is smaller than that in the printing control, and wherein the controller is configured to control the transfer current in the cleaning control such that the transfer current is set at a first current value at the start of the cleaning control and then changed to a second current value having the same polarity as, but smaller in absolute value than the first current value.

2. The image forming apparatus according to claim 1, wherein the controller is configured to change the transfer current in the cleaning control gradually from the first current value to the second current value.

3. The image forming apparatus according to claim 1, wherein the controller is configured to change the transfer current in the cleaning control to the first current value for a period of time corresponding to one complete rotation of the cleaning roller.

4. The image forming apparatus according to claim 1, wherein the controller is configured to set the transfer current at a first constant current value during the cleaning control and at a third constant current value during the printing control.

* * * * *